US010060714B2

(12) United States Patent
Bliehall

(10) Patent No.: US 10,060,714 B2
(45) Date of Patent: Aug. 28, 2018

(54) TARGET SYSTEM WITH UNIQUE TARGET SENSING

(71) Applicant: James Carl Bliehall, Sandia Park, NM (US)

(72) Inventor: James Carl Bliehall, Sandia Park, NM (US)

( * ) Notice: Subject to any disclaimer, the term of this patent is extended or adjusted under 35 U.S.C. 154(b) by 0 days.

(21) Appl. No.: 15/192,987

(22) Filed: Jun. 24, 2016

(65) Prior Publication Data

US 2017/0370684 A1 Dec. 28, 2017

(51) Int. Cl.
*F41J 7/04* (2006.01)
*F41J 5/056* (2006.01)

(52) U.S. Cl.
CPC ..... *F41J 7/04* (2013.01); *F41J 5/056* (2013.01)

(58) Field of Classification Search
None
See application file for complete search history.

(56) References Cited

U.S. PATENT DOCUMENTS 4,588,194 A * 5/1986 Steidle ..... F41J 7/04 273/391
5,263,722 A * 11/1993 Rosellen ..... F41J 7/04 273/391
5,350,180 A * 9/1994 Acock ..... F41J 7/00 273/406
8,684,361 B2 * 4/2014 Henson ..... F41J 1/01 273/389
9,163,912 B1 * 10/2015 Stark ..... F41J 7/04
9,222,760 B2 * 12/2015 Bliehall ..... F41J 5/20
9,228,809 B1 * 1/2016 Relyea ..... F41J 9/02
2008/0164657 A1 * 7/2008 Sheldon ..... F41J 7/06 273/368
2008/0185786 A1 * 8/2008 Loveland ..... F41J 7/04 273/391
2010/0038854 A1 * 2/2010 Mraz ..... F41J 5/056 273/371

* cited by examiner

*Primary Examiner* — Sunit Pandya

(57) ABSTRACT

A portable target apparatus is described including a first sensored, penetrable target and a second sensored, penetrable target positioned adjacent the first sensored, penetrable target. A user defined number of projectile penetrations on only the first sensored, penetrable target position it non-upright out of the shooter's field-of-view. Whenever the second sensored, penetrable target is penetrated by a projectile the first sensored, penetrable target does not move to the non-upright position out of the shooter's field-of-view even when the same projectile also penetrates the first sensored, penetrable target.

4 Claims, 6 Drawing Sheets

TARGET SYSTEM WITH UNIQUE TARGET SENSING

CROSS-REFERENCE TO RELATED APPLICATION

Figure 2:
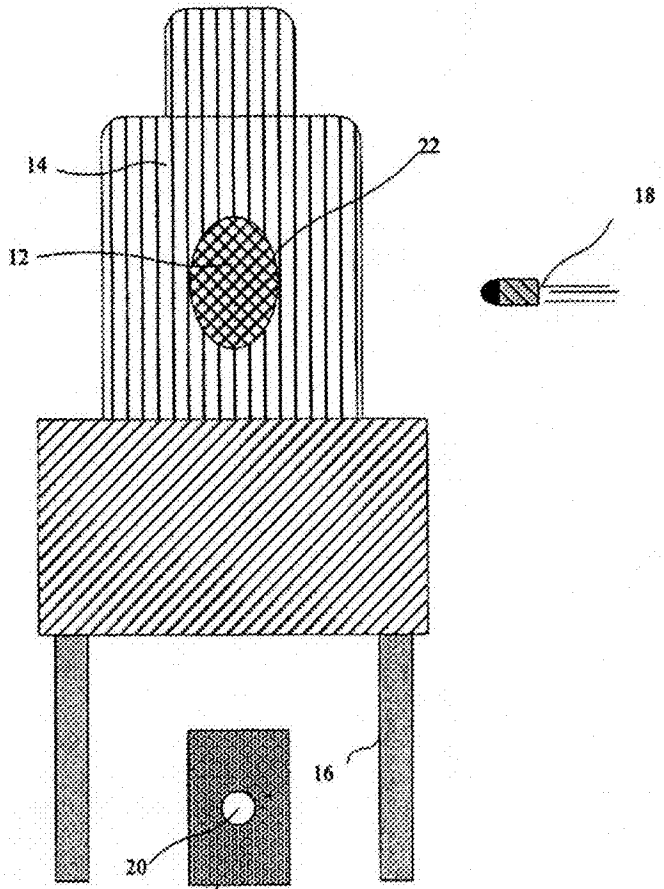

This application claims the benefit of the filing date of U.S. Provisional Patent Application No. 62/231,537 filed on Jul. 10, 2015 and titled, "A unique Pop-Up/Pop/Out Motor Driven Target", sections of the contents of which are hereby incorporated by reference.

BACKGROUND

Prior Art Publication Data

Current U.S. Class: 1/1

Current CPC Class: F41J 9/02 (20130101); H01F 7/064 (20130101); H01F 7/14 (20130101); F41J 7/06 (20130101)

Field of Search: 273/369,371,370,375,390,366,367,368, 393,407,386,392; 368/179,163,162; 362/392,386

REFERENCES CITED

U.S. Patent and Published Documents

| Document Number | Issue date | Assignee |
|---|---|---|
| 4,551,794 | November 1985 | Sandell |
| 4,723,233 | February 1988 | Beebe |
| 5,676,378 | October 1997 | West |
| 8,534,672 | September 2013 | Brune |
| 2006/0125185 | June 2006 | Rolfe |
| 2013/0207347 | August 2013 | Sovine |
| 2009/0194943 | August 2009 | Amitai et al. |
| 2011/0149055 | June 2011 | Burch et al. |
| 2003/0134700 | July 2003 | Salva |
| 2003/0082502 | May 2003 | Stender et al. |
| 2012/0043722 | February 2012 | Mironichev et al. |
| 2014/0028856 | January 2014 | Ehrlich |
| 2005/0017456 | January 2005 | Shechter |
| 2006/0005447 | January 2006 | Lenner et al. |
| 0,051,953 | May 2002 | Clark et al. |
| 5,462,283 | October 1995 | Allen |
| 5,557,685 | September 1996 | Schlossers et al. |
| 6,322,365 | November 2001 | Shechter et al. |
| 6,367,800 | April 2002 | Sheck et al. |
| 6,604,946 | August 2003 | Oakes |
| 6,863,532 | March 2005 | Ambrosoli |
| 6,966,775 | November 2005 | Kendir et al. |
| 8,051,597 | November 2011 | D'Souza et al. |
| 8,105,087 | January 2012 | Valentini |

FIELD OF THE INVENTION

The proposed invention relates to target systems and more particularly to a portable target system that presents a penetrable threat/shoot target that must be penetrated by a user selectable number of projectiles to cause the threat/shoot target to move out of the user's field-of-view.

Uniquely, the system also presents a penetrable no-threat/no-shoot target that must not be penetrated by any projectile. When the no-threat/no-shoot target is penetrated by a projectile, the threat/shoot target does not move out of the shooter's field-of-view even when the threat/shoot target is penetrated by the same projectile.

BACKGROUND OF THE INVENTION

Before the present invention is disclosed and described, it is to be understood that the terminology used herein is for the purpose of describing particular embodiments only and is not intended to be limiting. The terms "a" or "an," as used herein, are defined as one or more than one. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

The term "projectile" should be understood to mean any of a number of rapidly moving objects that may cause physical discomfort, harm or death when they penetrate a human body. These can include, but are not limited to, a hard-nosed bullet or soft-nosed training bullet fired from a firearm, an arrow launched from a tension bow, a knife that is thrown, etc. In the following treatise, the word "projectile" is used for clarity.

The term "lateral" should be understood to mean in a direction corresponding to a plane transverse and in line with the plane of the threat/shoot target and no-threat/no shoot target.

"FOV" is the abbreviation for the term field-of-view and describes the area visible to the shooter.

Additionally the term "shooter" is intended to define the person using the firearm or projectile launcher with the intention to accurately penetrate only the threat/shoot target and not penetrate the no-threat/no shoot target.

The term "FI" is an abbreviation for the term Firearms Instructor and defines the person operating the invention and who, by using a remote control, programs the number of projectile penetrates the threat/shoot target alone must sustain before the threat/shoot moves out of the shooter's FOV. The FI can also cause the threat/shoot target, after moving to a position out of the shooter's FOV, to remain out of the shooter's FOV for a selectable time interval by use of an adjustable time control on the front of the control electronics unit.

The term "light" is intended to mean any one of a number of visible indicators including a simple incandescent lamp, a high-intensity strobe, an LED or an arc light; the light having a distinct color. Additionally, but not referenced in the text, the indicator may also be an audible tone or a vibration device.

Properly training armed military, civilian and law enforcement personnel (shooters) in the correct and accurate use of firearms requires target systems that mimic events and the encounters they are likely to experience in a real-life firearms confrontation.

The target systems available today do not present these real-life scenarios to shooters during their firearms training. The target systems employ a single shoot target with a sensor and when any area of the shoot target is penetrated by a user selectable number of projectiles, the target system's control electronic circuitry causes a positioning drive system to move the shoot target out of the shooter's FOV.

More specifically, when a projectile hits the shoot target, the target system does not distinguish between projectile penetrations on the shoot target that are to non-vital anatomical regions, (e.g. a region that represents a person's shoulder) and vital anatomical regions, (e.g. a region that represents the person's body Center of Mass or Cranial-Ocular Cavity in the head.) Said another way, the target system produces the same reaction and always moves the shoot target out of the shooter's FOV in exactly the same manner irrespective of whether a vital or a non-vital anatomical region on the shoot target was hit by a projectile.

Today's target systems have several other serious training deficiencies. They are not configurable to demonstrate when a sensored, penetrable shoot target alone must be accurately penetrated by projectiles and a second sensored, penetrable no-shoot target (which must never be penetrated by a projectile) is positioned in close proximity to the shoot target. The training requirement of the target system is to alert the shooter if the sensored, penetrable no-shoot target is penetrated by a projectile and at the same time to prevent the sensored, penetrable shoot target from moving out of the shooter's FOV because the projectile penetrated the sensored, penetrable no-shoot target.

Additionally, the target systems of today do not alert the FI and shooter as to the reason the penetrable shoot target did not move out of their FOV when the shooter sent a projectile at the penetrable shoot target with the penetrable no-shoot target adjacent to it. (i.e. did the shooter's projectile miss the penetrable shoot target entirely or did his projectile erroneously penetrate the penetrable no-shoot target?)

Therefore, a need exists to overcome these problems with the prior art as discussed above.

The proposed invention is comprised of a "first sensored, penetrable target intended to be penetrated by projectiles" (hereinafter known as the first sensored, penetrable target) having the ability to be positioned upright into and non-upright out of the FOV of the shooter. This target simulates the shoot target. Positioned adjacent the first sensored, penetrable target is a "second sensored, penetrable target not intended at any time to be penetrated by projectiles", (hereinafter known as the second sensored, penetrable target.) This target simulates a no-shoot target such as an innocent bystander positioned in close proximity to the first sensored, penetrable target.

Additionally, the second sensored, penetrable target may be configured to represent a human target having anatomical areas removed that allow passage of a projectile as will be described herein.

The FI may program the control electronics unit of the invention such as to require the shooter to penetrate the first sensored, penetrable target with a user selectable number of projectiles to cause the first sensored, penetrable target to move out of the shooter's FOV. This capability is in the public domain, but not in a configuration wherein the first sensored, penetrable target alone must be accurately penetrated by projectiles and a second sensored, penetrable target that must never be penetrated by a projectile is in close proximity, as will be described herein.

The present invention is unique in the ability to provide several important and realistic firearms training capabilities. As an example, when only the first sensored, penetrable target is penetrated by a projectile the present invention alerts the shooter of an accurate penetration by extinguishing a light for a time interval e.g. 250 milliseconds.

Additionally when the projectile aimed at the first sensored, penetrable target is inaccurate and erroneously penetrates the second sensored, penetrable target, the light extinguishes for a different time interval e.g. 500 milliseconds.

Additionally, the electronic circuitry that counts the number of accurate projectile penetrations on the first sensored, penetrable target does not count down with the projectile penetration on the first sensored, penetrable target because the second sensored, penetrable target was also penetrated by the projectile.

SUMMARY OF THE INVENTION

The invention described herein provides a portable target apparatus that overcomes the before-mentioned disadvantages of the heretofore-known target devices and methods of this general type and comprises a unique target training system that moves a first sensored, penetrable target non-upright out of a shooter's FOV only when the first sensored, penetrable target alone is penetrated by a user selectable number of projectiles and the second sensored, penetrable target is not penetrated by any projectiles.

With the foregoing and other objects in view, there is provided, in accordance with the present invention, a portable target apparatus including the first sensored, penetrable target and the second sensored, penetrable target located adjacent the first sensored, penetrable target. The first sensored, penetrable target is connected to the input connector of a control electronics' circuit that senses when the first sensored, penetrable target is penetrated by at least one projectile. The second sensored, penetrable target is connected to the input connector of a second control electronics' circuit and senses when the second sensored, penetrable target is penetrated by at least one projectile.

A rotational position drive system is attached to the first sensored, penetrable target and is operable to retain the first sensored, penetrable target in an upright position within the shooter's FOV. The target remains upright within the shooter's FOV until only the first sensored, penetrable target is penetrated by a user selectable number of projectiles and the second sensored, penetrable target is not penetrated by any projectiles. The position drive system then moves the first sensored, penetrable target to a non-upright position out of the shooter's FOV. The first sensored, penetrable target remains non-upright for a user determined delay time-interval and after the delay time-interval times out the target apparatus returns the first sensored, penetrable target upright and back into the shooter's FOV.

The present invention provides a novel and efficient portable target apparatus designed primarily for use in firearms training to properly train a shooter to penetrate only one target, namely the first sensored, penetrable target with a user selectable number of projectiles and to never penetrate the second sensored, penetrable target with any projectiles. The portable target apparatus includes engagement portions, e.g. the first sensored, penetrable target that should be penetrated by projectiles, and non-engagement portions, e.g. the second sensored, penetrable target that should not be penetrated by projectiles.

The engagement portions of the first sensored, penetrable target may depict the entire area of a human body to represent a person that should be penetrated by a projectile. The non-engagement portions of the second sensored, penetrable target may also represent the entire area of the human body of a person that should never be penetrated by a projectile in any area, at any time.

More specifically, the portable target apparatus includes a first sensored, penetrable target that moves from the upright position to the non-upright position only when the first sensored, penetrable target alone is accurately penetrated by a user selectable number of projectiles.

Alternately a second sensored, penetrable target may be manufactured with one or more aperture. The aperture represent anatomically sensitive locations on a human body, such as the Center of Mass of a human body and/or the Cranial-Ocular Cavity head area of a human body. The location of the aperture correspond to the area a projectile must pass through on the second sensored, penetrable target without penetrating the second sensored, penetrable target material itself. The projectile, after passing through the aperture in the second sensored, penetrable target, penetrates only the first sensored, penetrable target that, in this example, is of the same size and is positioned directly behind the second sensored, penetrable target. This embodiment requires the shooter to accurately pass the projectile through the aperture to demonstrate the equivalent of having made an accurate hit on a human body at those anatomical areas.

Advantageously, embodiments of the present invention provide the shooter with multiple levels of visual feedback such as when only the first sensored, penetrable target is accurately penetrated by a projectile; when the second sensored, penetrable target is penetrated by a projectile or when first sensored, penetrable target and the second sensored, penetrable target are penetrated by the same projectile, irrespective of the position of the first sensored, penetrable target relative to the position of the second sensored, penetrable target (e.g. when the first sensored, penetrable target is positioned either in front of or behind the second sensored, penetrable target.)

In another embodiment the position drive system could be configured to move both the first sensored, penetrable target and second sensored, penetrable target in unison, that is to say both targets are positioned in the non-upright position out of the shooter's FOV or are positioned upright within the shooter's FOV at the same moment. This configuration is easily accomplished by having the target holder for the first sensored, penetrable target and the target holder for the second sensored, penetrable target on the same rotatable position drive shaft.

In still another embodiment the first sensored, penetrable target could be of a color that indicates to the shooter that that target must be engaged with projectiles (i.e. a red material.) Adjacent the first sensored, penetrable target and on the same rotational drive shaft, is another first sensored, penetrable target of the same red color. The signal cable from each independently sensored, penetrable red target is connected to a simple RCA "Y" signal cable which is then connected to the control electronics input jack for the first sensored, penetrable target. This configuration allows the target apparatus to recognize hits on either one of the first sensored, penetrable target and simulates multiple assailants to the shooter when they both appear upright into his FOV. The FI can program, in this example, 6 penetrations into the control electronics count circuit and the shooter must engage each of the first sensored, penetrable target's with 3 projectile penetrations before both the targets move non-upright out of the shooter's FOV.

In still another embodiment the first sensored, penetrable target could again be of a color that indicates to the shooter that that the target must be engaged with projectiles (i.e. a red material.) Adjacent the first sensored, penetrable target are two second sensored, penetrable targets of a color the shooter knows he must not engage, (i.e. white in color.) This configuration is analogous to having multiple no-shoot individuals (white targets) that should not be engaged with a projectile, and are in close proximity to a shoot individual (red target) that should be engaged with a projectile. The signal cable from each independently sensored, penetrable white target is connected to a simple RCA "Y" cable which is then connected to the control electronics input jack for the second sensored, penetrable target. This configuration allows the target apparatus to recognize penetrations on either first sensored, penetrable red target or projectile penetrations to either one of the second sensored, penetrable targets. This configuration simulates the assailant attempting to protect himself with multiple innocent bystanders, as when he is in a crowd. The first sensored, penetrable red target and the two second sensored, penetrable white targets can be configured on the target apparatus to all appear at the same moment by having the rotational positioning system also move the two second, sensored, penetrable targets upright and into the shooter's FOV or non-upright out of the shooter's FOV.

Additionally the two second sensored, penetrable targets can be positioned closer or further distances from the first sensored, penetrable target by mounting their target holders onto the drive axle of rotational positioning system with sliding holders that can be locked into place with simple thumb screws. This allow the FI to easily increase or decrease the difficulty of the training drill.

When using multiple portable target systems, each with a user selected colored light, another training capability is available to the FI. As an example, the FI may position portable target systems at distances of 15, 25 and 75 yards from the shooter, each having a red colored light. Additionally in this example, portable target systems may be positioned at 20, 100 and 200 yards, each having a white colored light. Lastly portable target systems with yellow colored lights may be positioned at 50, 125 and 300 yards. With the shooter ready and all the portable target systems targets not upright and in the shooter's FOV the FI presses 1 button on his remote control and all the portable target systems move to an upright position within the shooter's FOV and all the various colored lights are visible to the FI and shooter. The FI can indicate a sequence of colors, such as "red"/"yellow"/"white" requiring the shooter to engage the portable target systems with red colored lights first, yellow colored lights next and white colored lights last, until all the first sensored, penetrable targets on each portable target system have been successfully engaged and have moved to the non-upright position. At that time all the colored lights will have been extinguished. Various colors, including but not limited to red, white, blue, green, amber and yellow may be used to increase the firearms training challenge.

When the FI has programmed the control electronics unit to require the shooter to accurately penetrate the first sensored, penetrable target with more than one projectile, a first projectile penetration to only the first sensored, penetrable target will cause the first sensored, penetrable target to remain in the upright position and the colored light on that portable target system to extinguish for a predetermined time interval (e.g. 250 milliseconds) indicating an accurate projectile penetration to only the first sensored, penetrable target. Because the first sensored, penetrable target did not move out of the upright position the shooter immediately recognizes that they must continue to engage the first sensored, penetrable target with more projectiles and at the same time to not penetrate the second sensored, penetrable target. The shooter continues to engage the first sensored, penetrable target with projectiles until it does move to the non-upright position out of the shooter's FOV. With each accurate penetration of only the first sensored, penetrable target the colored light extinguishes for 250 milliseconds. The number of projectile penetrations required to move the first sensored, penetrable target to the non-upright position corresponds to the count number programmed into the control electronics unit by the FI using the remote control.

The operation of the count number programming will now be explained in detail.

In this example, a count number of 1 is programmed into the control electronics. A projectile penetration of the second sensored, penetrable target, even if the same projectile also penetrates the first sensored, penetrable target will cause both the first sensored, penetrable target to remain in the upright position within the shooter's FOV and the colored light to be extinguished for a discernably longer time interval (i.e. 500 milliseconds.) This is easily recognized by the FI and shooter as being a longer time interval than was evident to the FI and shooter when the projectile penetrated only the first sensored, penetrable target (e.g. 250 milliseconds). This different extinguishment time interval indicates to the FI and shooter that the shooter made an inaccurate projectile penetration of the second sensored, penetrable target, which he should never happen.

Additionally, the control electronics unit recognizes the inaccurate penetration on the second sensored, penetrable target and the control electronics unit does not count down 1 digit as it does when only the first sensored, penetrable target alone was accurately penetrated by a projectile. Further combinations of these events may be provided and are within the scope of the invention.

In addition, embodiments of the invention provide a means for FI to input a selectable delay-time interval by use of a rotatable adjustment control located on the front of the control electronics unit. After the first sensored, penetrable target is penetrated with the correct number of projectiles, both the first and second sensored, penetrable targets automatically move from their upright position to their non-upright position. The FI selected delay time-interval starts and begins to elapse to zero. In this example, the delay time-interval was set to 3 seconds and the targets remain non-upright until the delay time-interval reaches zero. Additionally the portable target system's colored light is extinguished. When the FI selected delay time-interval reaches zero the targets automatically return to the upright position in the shooter's FOV.

A portable target apparatus has been disclosed that features a first sensored, penetrable target that must be accurately penetrated by a user defined number of projectiles in order to move the first sensored, penetrable target from the upright position within the shooter's FOV, to a non-upright position not within the shooter's FOV and a second sensored, penetrable target that must never be penetrated with a projectile.

It is envisioned that the portable target apparatus will be used primarily in firearms training. Its unique training capability provides the FI and shooter with visual indications as to events during the firearms training drill, such as when only the first sensored, penetrable target was accurately penetrated by a projectile and additionally a distinctly different visual indication whenever the second sensored, penetrable target is erroneously penetrated by a projectile.

Additionally, the second sensored, penetrable target may be manufactured with apertures that correspond to anatomically sensitive areas of the human body. In this configuration, the first sensored, penetrable target is positioned directly behind the second sensored, penetrable target and when the shooter accurately sends a projectile at the second sensored, penetrable target and the projectile passes through the aperture in the second sensored, penetrable target and does not penetrate any area of the second sensored, penetrable target, the projectile will penetrate only the first sensored, penetrable target located behind the second sensored, penetrable target. The control system electronics then indicates to the shooter by the means described above (e.g. the colored light extinguishes for 250 milliseconds) that the shooter would have correctly penetrated those anatomical areas of a human body that correspond to the aperture in the second sensored, penetrable target. A projectile penetration to any area of the second sensored, penetrable target is indicated to the FI and shooter when the colored light extinguishes for a discernably longer time interval (e.g. 500 milliseconds.)

Other features of the invention have been disclosed that include using various colored lights to require the shooter to engage the first sensored, penetrable targets when employing multiple portable target apparatus each with colored lights in a defined sequence of colors before engaging the first sensored, penetrable target on any portable target apparatus with a different colored light.

These capabilities are novel in the firearms training field as presenting training scenarios that the shooter may experience in a real-life firearms confrontation (i.e. multiple shoot targets at various distances from the shooter.) These capabilities are not intended to be limited to the particular details disclosed herein. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

BRIEF DESCRIPTION OF THE DRAWINGS OF THE INVENTION

The following numbered components appear at various locations on the drawings:

12 first sensored, penetrable target
14 second sensored, penetrable target
16 base frame
18 projectile
20 colored indicating light
22 aperture
24 position drive assembly
26 position drive and colored indicating light control circuitry
28 primary sensor
30 primary cable
32 secondary sensor
34 secondary cable
36 Primary Pulse Generator One PPG1
38 Second Pulse Generator SPG
40 Primary Pulse Generator Two PPG2
42 Delay Pulse Generator DPG
44 count control
46 remote control
48 hold-off signal
50 control electronics unit The accompanying figures where like reference numerals refer to identical or functionally similar elements throughout the separate views and which together with the detailed description below are incorporated in and form part of the specification, serve to further illustrate various embodiments and explain various principles and advantages all in accordance with the present invention.

Figure 4:
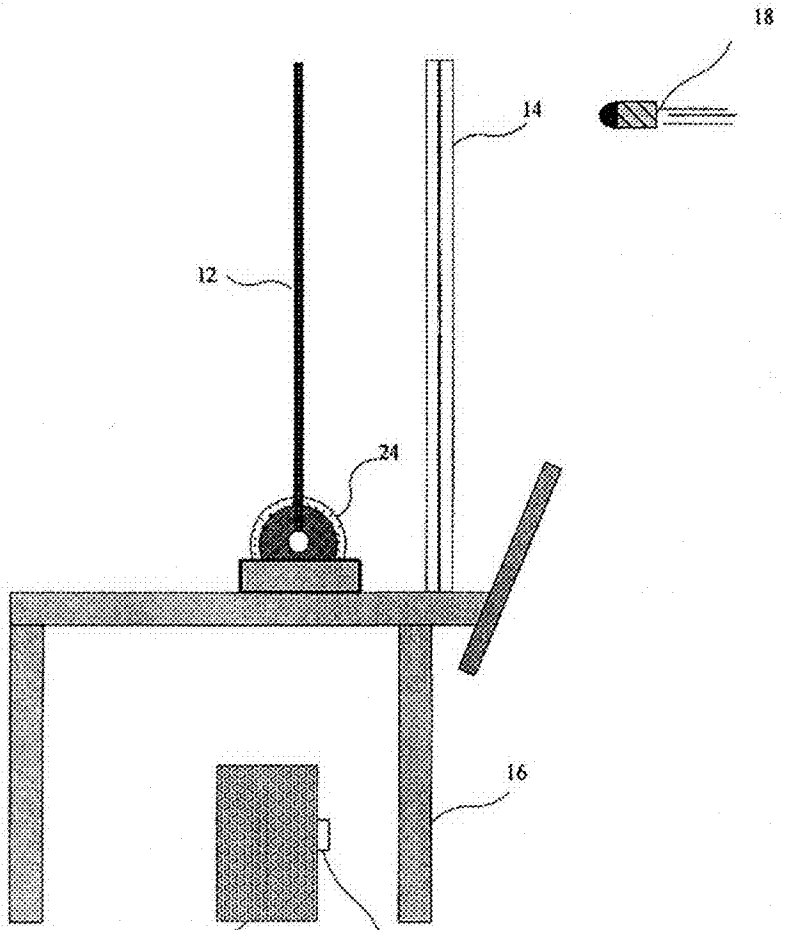
Figure 3:
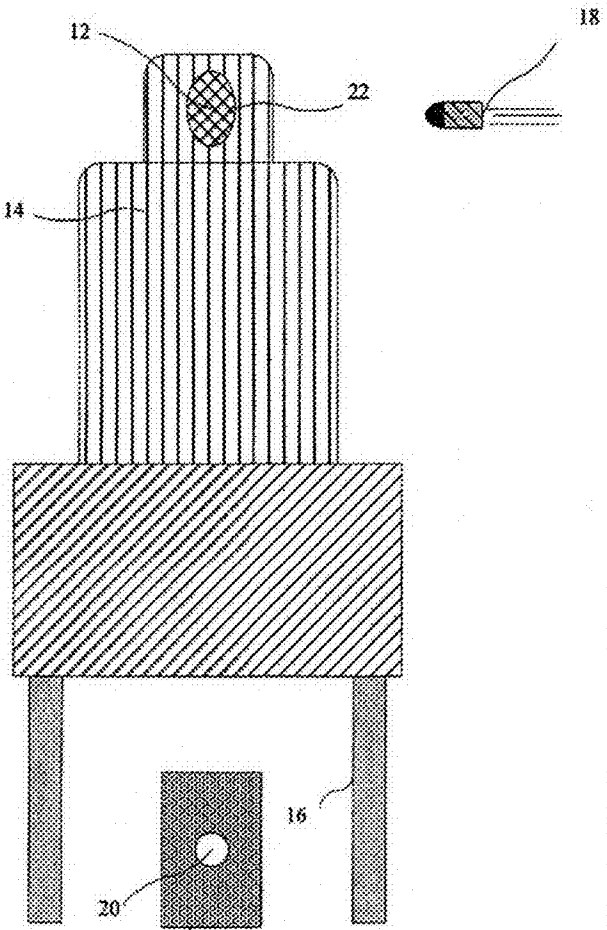
Figure 6:
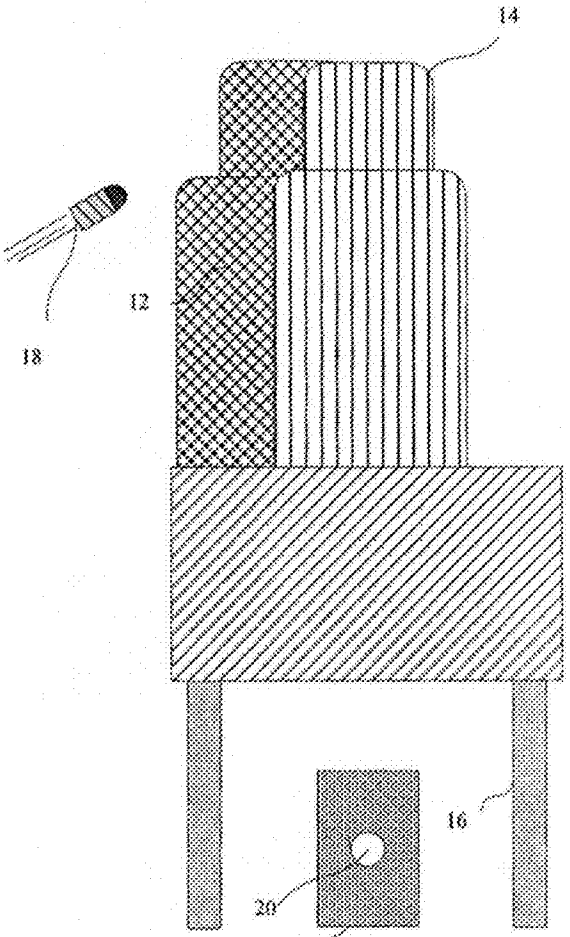
Figure 5:
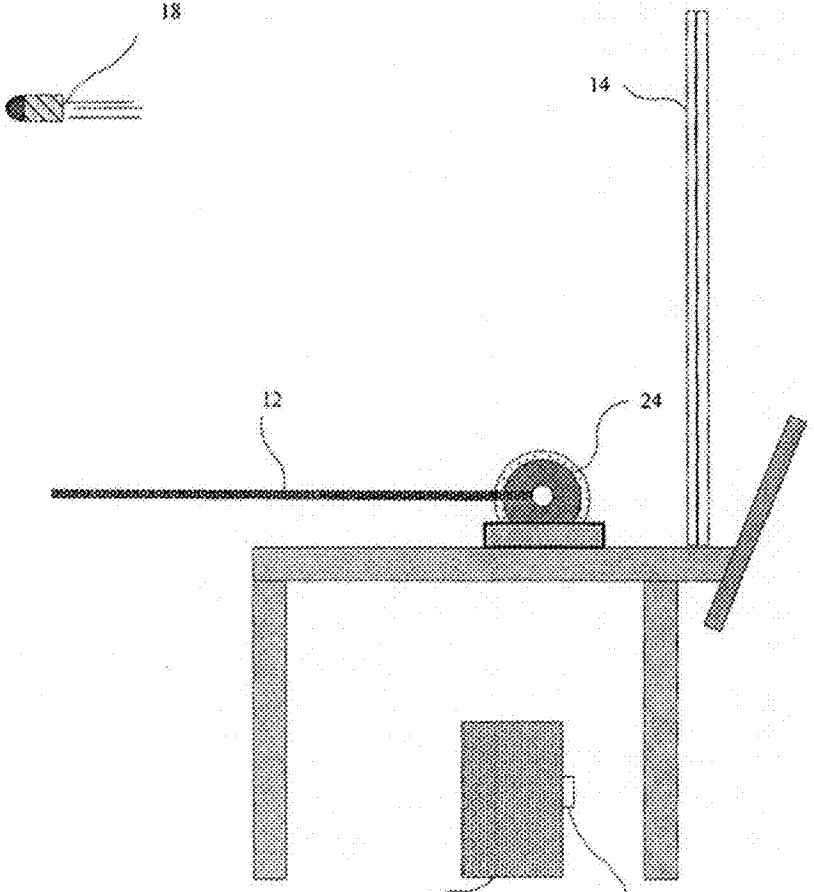
Figure 8:
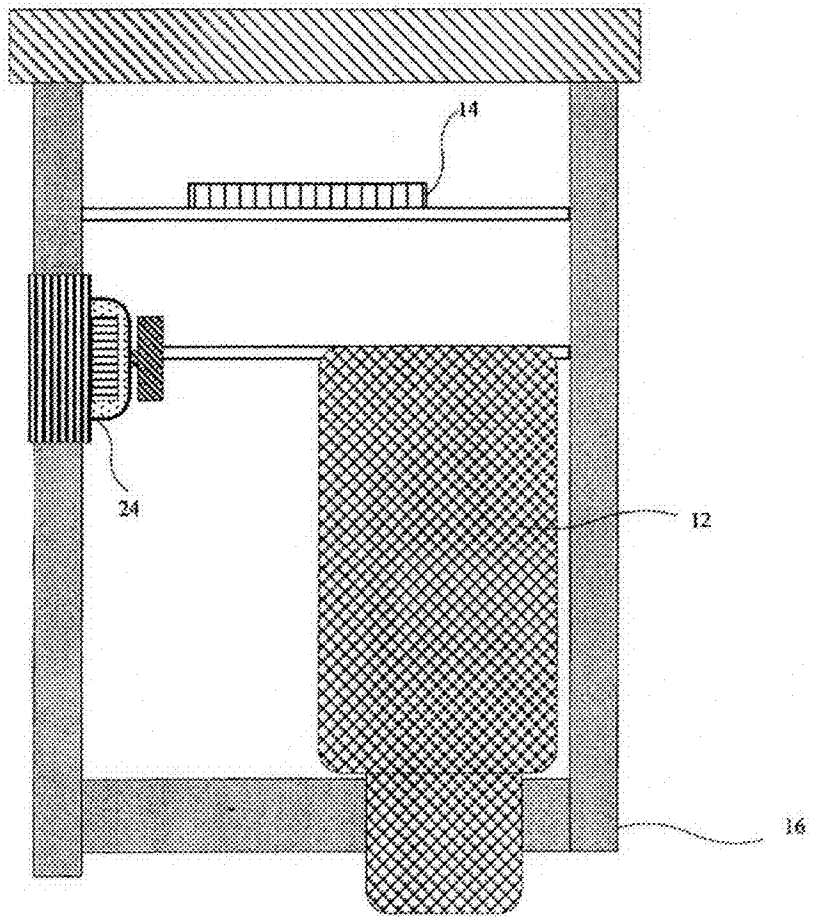
Figure 7:
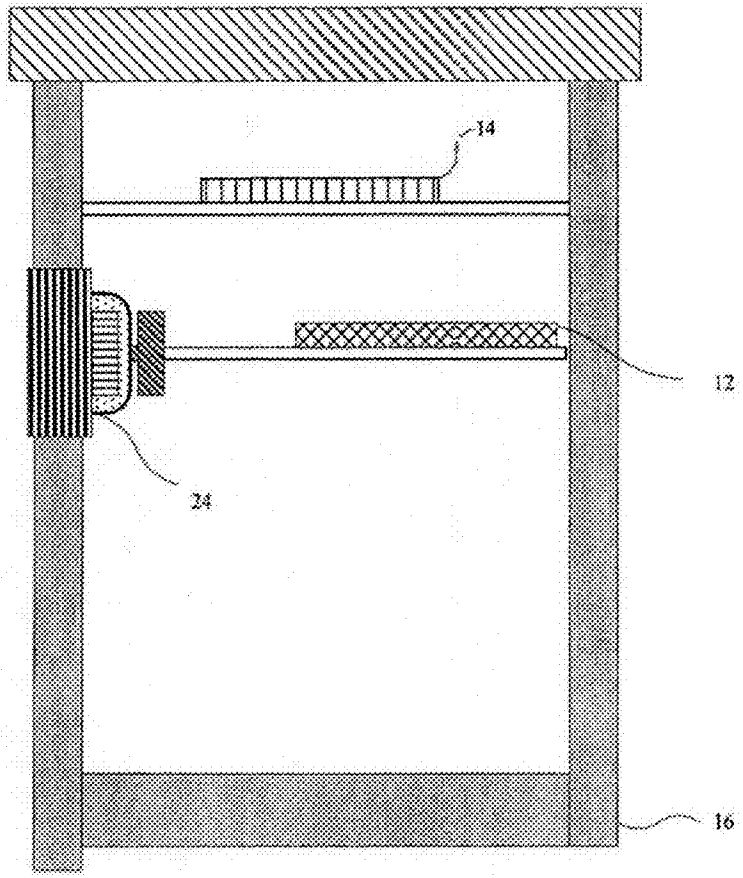

(FIG. 1) is an elevational front view of a portable target apparatus showing a first sensored, penetrable target and a second sensored, penetrable target in an upright position within the shooter's field-of-view (FOV) and a projectile moving toward the first sensored, penetrable target in accordance with the present invention;

(FIG. 2) is an elevational front view of the portable target apparatus showing the first sensored, penetrable target and the second sensored, penetrable target having an area removed from the second sensored, penetrable target that coincides with the Center of Mass of a human body and a projectile moving toward the removed area of the second sensored, penetrable target; the first sensored, penetrable target being in the upright position within the shooter's FOV;

(FIG. 3) is an elevational front view of the portable target apparatus showing the first sensored, penetrable target and second sensored, penetrable target having an area removed from the second sensored, penetrable target that coincides with a critical area of the Cranial-Ocular Cavity in the head of a human body and a projectile moving toward the removed area of the second sensored, penetrable target; the first sensored, penetrable target being in the upright position within the shooter's FOV in accordance with the present invention;

(FIG. 4) is an elevational side view of the portable target apparatus of (FIG. 3) showing a position drive assembly coupled to the first sensored, penetrable target and a projectile moving toward the removed area of the second sensored, penetrable target with the first sensored, penetrable target being in the upright position within the shooter's FOV;

(FIG. 5) is an elevational side view of the portable target apparatus of (FIG. 4) showing the first sensored, penetrable target in the non-upright position not within the shooter's FOV, the projectile having passed through the removed section of the second sensored, penetrable target and not penetrating the second sensored, penetrable target in accordance with the present invention;

(FIG. 6) is an elevational front view of the portable target apparatus of (FIG. 1) showing the first sensored, penetrable target in the upright position within the shooter's FOV with the lateral distance reduced between the first sensored, penetrable target and the second sensored, penetrable target;

(FIG. 7) is an elevational downward looking view of the portable target apparatus of (FIG. 6) showing the first sensored, penetrable target and second sensored, penetrable target with the first sensored, penetrable target in the upright position within the shooter's FOV in accordance with the present invention;

(FIG. 8) is an elevational downward looking view of the portable target apparatus of (FIG. 7) showing the first sensored, penetrable target in the non-upright position not within the shooter's FOV and the second sensored, penetrable target being within the shooter's FOV in accordance with the present invention;

(FIG. 9) is an elevational front view of the portable target apparatus showing the first sensored, penetrable target and a primary sensor connected to the first sensored, penetrable target and a primary cable connected to the primary sensor and the primary cable connected to a control electronics unit.

Figure 10:
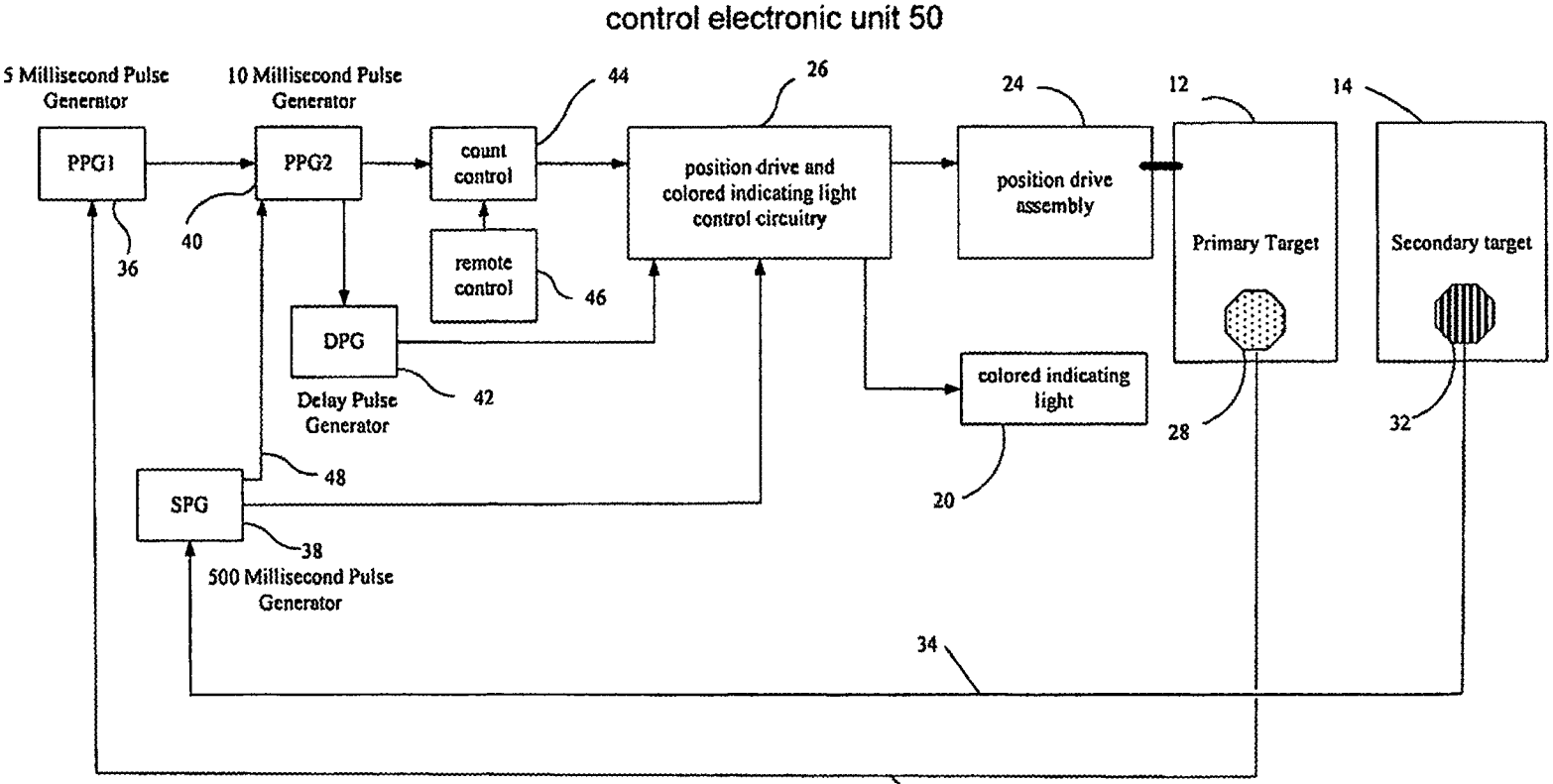

Additionally, (FIG. 9) demonstrates the second sensored, penetrable target and a secondary sensor connected to the second sensored, penetrable target and a secondary cable connected to the control electronics unit in accordance with the present invention;

(FIG. 10) is a detailed block diagram of a signal flow process of the control electronics of the present invention.

DETAILED DESCRIPTION OF THE INVENTION

Although the invention as illustrated and described herein is embodied in a portable target apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention that can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures.

Referring now to (FIG. 1), one embodiment of the present invention is shown in an elevational front view. (FIG. 1) shows several advantageous features of the present invention, but, as will be described below, the invention can be provided in various shapes, sizes, combinations of features and components, and varying numbers and functions of the components.

A preferred embodiment of a portable target apparatus, as shown in (FIG. 1), includes a first sensored, penetrable target 12 and a second sensored, penetrable target 14 affixed to a base frame 16. The first sensored, penetrable target 12 is sized and shaped to resemble a living creature. The term "living creature" is defined herein as a person or an animal, portrayed as living. In another embodiment, the first sensored, penetrable target 12 may be of a rectangular, circular or other similar shape. Additionally, a colored indicating light 20 is illuminated only when the first sensored, penetrable target 12 is in an upright position within the shooter's FOV. In a preferred embodiment, the first sensored, penetrable target 12 and the second sensored, penetrable target 14 are made of a material, such as polymer, capable of withstanding the force of a projectile 18 by allowing the projectile 18 to pass through the second sensored, penetrable target 14 and continue on to pass through the first sensored, penetrable target 12 without causing significant damage to either.

In one embodiment (FIG. 1) the second sensored, penetrable target 14 is positioned in front of the first sensored, penetrable target 12 and represents the non-engagement portion of the second sensored, penetrable target 14 the shooter should avoid penetrating with the projectile 18. The first sensored, penetrable target 12 is operable in conjunction with a position drive assembly 24 to move from the upright position within the shooter's FOV (FIG. 1) to a non-upright position not within the shooter's FOV (FIG. 5) when only the first sensored, penetrable target 12 is penetrated by a user defined number of projectiles 18, as will be explained further herein.

In a preferred embodiment, the position of the first sensored, penetrable target is within the shooter's FOV in an upright position. The position not within the shooter's FOV is a non-vertical, non-upright position that is visually distinct from the upright position, such as a horizontal position, or the like.

In one embodiment (FIG. 2), a second sensored, penetrable target 14 is manufactured to contain an aperture 22 representative of the anatomically sensitive area, (i.e. vital portion) of a living creature, e.g. a human being, the Center of Mass of the body of the human being as depicted in (FIG. 2) or the critical Cranial-Ocular Cavity head area of the human body as depicted in (FIG. 3), respectively. The term "anatomically sensitive" is defined herein as those parts of the anatomy of a living creature that when penetrated by the projectile 18 are susceptible to causing the living creature instantaneous and severe trauma. In the preferred embodiment, the shooter is required to miss the aperture 22 in the second sensored, penetrable target 14 to cause the projectile 18 to pass through the aperture 22 and to penetrate only the first sensored, penetrable target 12 that is positioned directly behind and in alignment with the second sensored, penetrable target 14. When the user selectable number of projectiles 18 pass through the aperture 22 and penetrate only the first sensored, penetrable target 12, the first sensored, penetrable target will move to a non-upright position out of the shooter's FOV and the colored indicating light 20 will extinguish. Each penetration of a projectile 18 to the first sensored, penetrable target 12 will extinguish the colored indicating light 20 for a predetermined time interval (e.g. 250 milliseconds.) Advantageously, the first sensored, penetrable target 12 will remain in the upright position within the shooter's FOV when the shooter penetrates the non-engagement portion of the second sensored, penetrable target 14 with the projectiles 18. The aforementioned event also extinguishes the colored indicating light 20 for a discernably different period of time (e.g. 500 milliseconds) with each projectile 18 penetration of the second sensored, penetrable target 14, providing the shooter with a visual indication that the second sensored, penetrable target 14, and not the first sensored, penetrable target 12 only was penetrated by the projectile 18, giving reason as to why the first sensored, penetrable target 12 did not move to a non-upright position out of the shooter's FOV.

Figure 1:
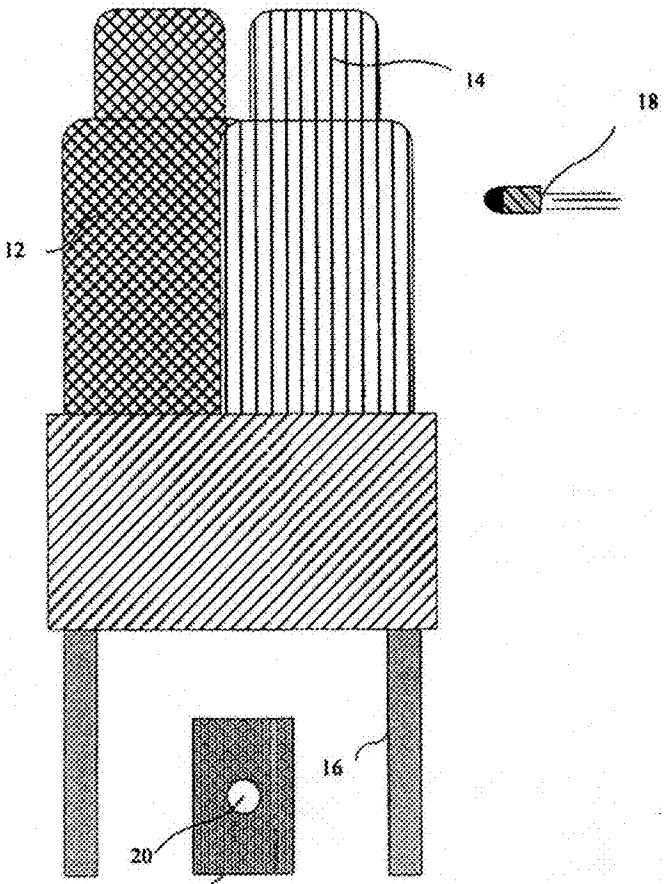

In one embodiment, the second sensored, penetrable target 14 may be located at various lateral distances from the first sensored, penetrable target 12, (e.g., obscuring none or obscuring a portion of the first sensored, penetrable target 12) as depicted in (FIG. 6) in comparison to (FIG. 1). In the embodiment shown in (FIG. 6), the second sensored, penetrable target 14 is configured to be a solid structure free of the aperture 22. The second sensored, penetrable target 14 may represent an innocent bystander the shooter should aim to avoid penetrating with the projectile 18. The full sized first sensored, penetrable target 12 represents the vital location at which the shooter should aim to penetrate with the projectile 18 to cause the first sensored, penetrable target 12 to move from the upright position within the shooter's FOV to the non-upright position not within the shooter's FOV. More specifically, the shooter should aim a projectile 18 to penetrate only the visible area of the first sensored, penetrable target 12.

(FIG. 7) depicts a top down view of the portable target apparatus having a position drive assembly 24 connected to the first sensored, penetrable target 12. Generally speaking, the position drive assembly 24 is configured to move the first sensored, penetrable target 12 from the upright position within the shooter's FOV to the non-upright position not within the shooter's FOV or from the non-upright position not within the shooter's FOV to the upright position within the shooter's FOV.

(FIG. 8) depicts a top down view of the first sensored, penetrable target 12 positioned in the non-upright position not within the shooter's FOV, such as when the shooter has accurately penetrated only the first sensored, penetrable target 12 with a user defined number of projectiles 18.

(FIG. 9) depicts a primary sensor 28 connected to the first sensored, penetrable target 12 with a primary cable 30 that connects the primary sensor 28 to a control electronics unit 50. Additionally, a secondary sensor 32 is connected to the second sensored, penetrable target 14 with a secondary cable 34 that connects the secondary sensor 32 to the control electronics unit 50.

Figure 9:
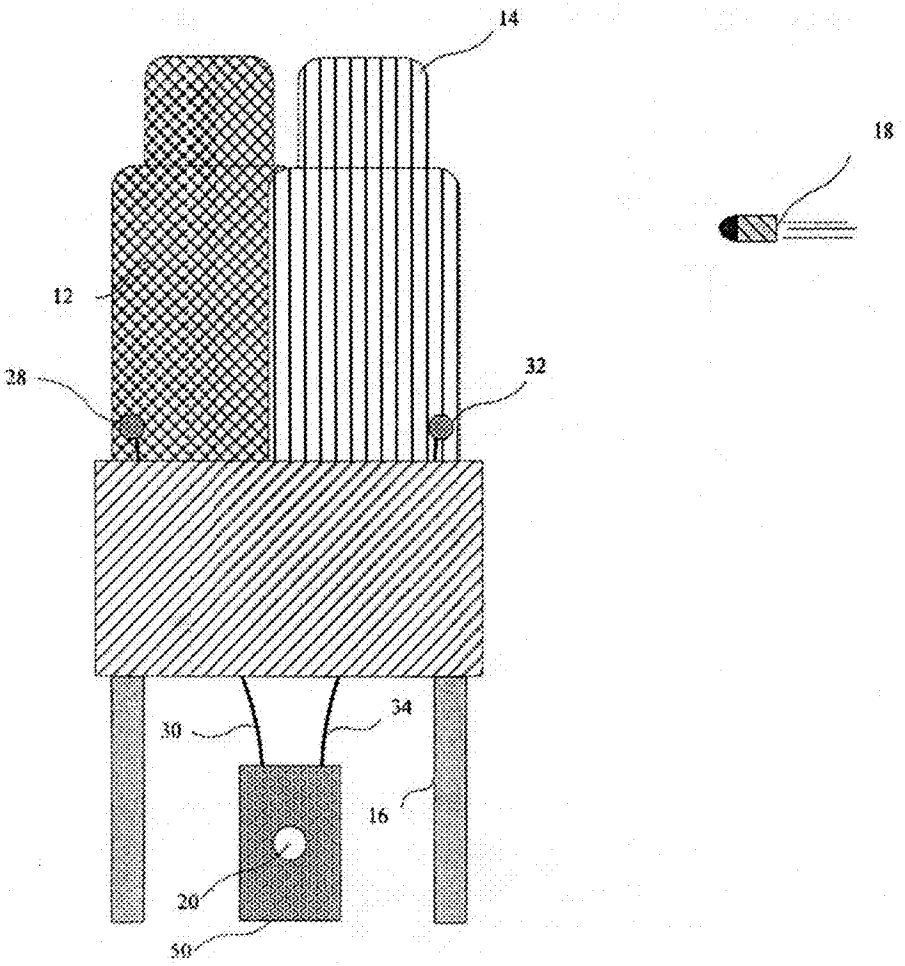

The operation of the control electronics unit 50 will now be discussed. (FIG. 10) is a block diagram drawing depicting signal flow within the control electronics unit 50. The position of the first sensored, penetrable target 12 is assumed to be in the upright position within the shooter's FOV and the colored indicating light 20 is illuminated as depicted in (FIG. 9).

The primary sensor 28 when mechanically stressed, as is the case when the first sensored, penetrable target 12 is penetrated by a projectile 18, generates a signal that then travels through the primary cable 30 to the control electronics unit 50 containing Primary Pulse Generator One PPG1 36. Primary Pulse Generator One PPG1 36 generates a positive 5 millisecond timed pulse. When the positive 5 millisecond timed pulse is transitioning from positive back to zero, it activates Primary Pulse Generator Two PPG2 40 that generates a positive 10 millisecond timed pulse. When the positive 5 millisecond timed pulse is transitioning from positive back to zero it causes a count control 44 to reduce its count register by 1 count (e.g. count down by 1 digit), from the total counts programmed into the count control 44 by a remote control 46. As an example, when the count control 44 has been programmed using the remote control 46 to require the shooter to accurately penetrate only the first sensored, penetrable target 12 with 1 projectile 18 to cause the first sensored, penetrable target 12 to move from the upright position within the shooter's FOV to the non-upright position not within the shooter's FOV, the count control 44 will subtract 1 from the programmed count of 1 and cause the first sensored, penetrable target 12 to move to the non-upright position not within the shooter's FOV and extinguish the colored indicating light 20.

As in another example, when the count control 44 has been programmed using the remote control 46 to require the shooter to accurately penetrate only the first sensored, penetrable target 12 with 3 projectiles 18 to cause the first sensored, penetrable target 12 to move from the upright position within the shooters FOV to the non-upright position not within the shooter's FOV, the count control 44 will subtract 1 digit after the first projectile 18 penetrate on only the first sensored, penetrable target 12 from the programmed count of 3, thus requiring 2 more accurate projectile 18 penetrations to only the first sensored, penetrable target 12 to cause the first sensored, penetrable target 12 to move to the non-upright position not within the shooter's FOV and additionally extinguish the colored indicating light 20. Additionally, when the shooter successfully penetrates only the first sensored, penetrable target 12 with a projectile 18 the count control 44 sends a signal to the position drive and colored indicating light control circuitry 26 that extinguishes the colored indicating light 20 for a predetermined time interval (e.g. 250 milliseconds), indicating to the shooter that only the first sensored, penetrable target 12 was successfully penetrated by the projectile 18. But, in this example, when the colored indicating light 20 extinguished for the above noted 250 millisecond time interval and the first sensored, penetrable target 12 did not move to the non-upright position not within the shooter's FOV, the shooter will know they have accurately penetrated only the first sensored, penetrable target 12 but also that the first sensored, penetrable target 12 requires more projectile 18 penetrations to cause the first sensored, penetrable target 18 to move to the non-upright position not within the shooter's FOV. When the shooter successfully penetrates only the first sensored, penetrable target 12 with the user defined number of projectiles 18 the count control 44 sends a signal to the position drive and colored indicating light control circuitry 26 that in turn sends a signal to the position drive assembly 24 that moves the first sensored, penetrable target 12 to the non-upright position not within the shooter's FOV. Additionally, the position drive and indicating light control circuitry 26 extinguishes the colored indicating light 20.

The aforementioned and described sequence of events occurs when the shooter accurately sends a user defined number of projectiles 18 that penetrate only the first sensored, penetrable target 12. When the shooter inaccurately sends a projectile 18 and penetrates the second sensored, penetrable target 14 or penetrates both the first sensored, penetrable target 12 and second sensored, penetrable target 14 with the same projectile 18, the following sequence of events occur.

The secondary sensor 32 when mechanically stressed, as is the case when the second sensored, penetrable target 14 is penetrated by a projectile 18, generates a signal that travels through the secondary cable 34 to the control electronics unit 50 containing a Secondary Pulse Generator SPG 38 that generates a positive 500 millisecond timed pulse. If the first sensored, penetrable target 12 was also penetrated by the same projectile 18, the primary sensor (23) is activated and sends a signal to the Primary Pulse Generator One PPG 1 36 that generates a positive 5 millisecond timed pulse. When the Primary Pulse Generator One PPG1 36 times out its positive 5 millisecond pulse while transitioning back to zero attempts to activate Primary Pulse Generator Two PPG2 40, but Primary Pulse Generator Two PPG2 40, is prevented from generating a 10 millisecond signal to send to the count control 44 because a hold off signal 48 from Secondary Pulse Generator SPG 38 has the time interval of 500 milliseconds. The 500 millisecond pulse from Secondary Pulse Generator SPG 38 also causes the position drive and colored indicating light control circuitry 26 to extinguish the colored indicating light 20 for the 500 milliseconds. This action demonstrates to the shooter that the second sensored, penetrable target 14 that should not have been penetrated by the projectile 18 was penetrated by the projectile 18 and that the shooter did not completely miss the first sensored, penetrable target 12 and/or the second sensored, penetrable target 14.

Advantages of the Proposed Invention

The advantages of the proposed invention are obvious to those schooled in the art of training individuals to correctly and accurately employ firearms. The invention indicates to both the FI and the shooter when the first sensored, penetrable target is in their FOV by illuminating a colored indicating light and indicates when an accurate projectile penetrates the first sensored, penetrable target alone by extinguishing the colored indicating light for a time interval (e.g. 250 milliseconds.) When the correct number of projectile 18 penetrations on only the first sensored, penetrable target equal the number programmed into the control electronic unit 50 the first sensored, penetrable target moves non-upright out of the shooter's FOV.

The invention also alerts the FI and shooter when an inaccurate projectile 18 penetration has been made on the second sensored, penetrable target 14 by extinguishing the colored indicating light 20 for a longer time interval (e.g. 500 milliseconds) than was observed when the first sensored, penetrable target 12 alone was penetrated by a projectile 18 and additionally the 500 millisecond pulse prevents the count control 44 from indexing down one digit.

A further advantage of the invention over prior art is appreciated when a section of the second sensored, penetrable target 14 is removed forming an aperture 22 that corresponds to the anatomical area the shooter must penetrate on a human body so as to cause immediate physiological and mental incapacitation, such as the critical area of the head containing the brain, that when penetrated by a projectile 18, prevents the human threat from harming either the shooter or innocent bystanders.

When the invention is configured with an aperture 22 in the second sensored, penetrable target 14, the invention alerts the shooter when the shooter does not pass the projectile 18 through the aperture 22. In this example, when the projectile 18 misses both the first sensored, penetrable target 12 and second sensored, penetrable target 12, the colored indicating light 20 remains on. This action has the training advantage of alerting the shooter that the projectile missed both the first sensored, penetrable target 12 and the second sensored, penetrable target 14. But when the projectile 18 does not pass through the aperture 22 and penetrates any area of the second sensored, penetrable target 14, the invention extinguishes the colored indicating light 20 for the noticeably different time interval (e.g. 500 milliseconds), than the invention extinguished the colored indicating light 20 when only the first sensored, penetrable target 12 alone is penetrated by a projectile 18 (e.g. 250 milliseconds). This alerts the shooter that the projectile 18 penetrated the second sensored, penetrable target 14 in an area (as an example the shoulder) that would not have immediately incapacitated the threat human. This is a critical indication for the training of the shooter as it alerts the shooter that the projectile 18 penetration on the threat human was not in an area that would have been incapacitating and could thus would provide the threat human the opportunity to continue to function and harm the shooter or innocent bystanders and that more projectile 18 penetrations on the first sensored, penetrable target 12 are immediately required.

What is claimed is:

1. A portable target apparatus, comprising: a first sensor, penetrable target intended to be penetrated by a projectile; and a second sensor, penetrable target not intended to be penetrated by a projectile; and a control circuit and positional drive assembly operable to move the first sensor, penetrable target from an upright position to a non-upright position when only the first sensor, penetrable target is penetrated by a user selectable number of projectiles; and the control circuit and positional drive assembly also being operable to not move the first sensor, penetrable target from an upright position to a non-upright position whenever the second sensor, penetrable target is penetrated by a projectile; and the control circuit and positional drive assembly also being operable to not move the first sensor, penetrable target from an upright position to a non-upright position whenever a projectile penetrates the first sensor, penetrable target and continues on to also penetrate the second sensor, penetrable target; and the control circuit and positional drive assembly also being operable to not move the first sensor, penetrable target from an upright position to a non-upright position whenever a projectile penetrates the second sensor, penetrable target and continues on to also penetrate the first sensor, penetrable target.

2. The portable target apparatus of claim 1, wherein: the first sensor, penetrable target and the second sensor, penetrable target resemble a living creature and at least one aperture in the second sensor, penetrable target are in a location of at least one of a head and a chest area of the living creature; and a first sensor, penetrable target intended to be penetrated by a projectile is located adjacent the second sensor, penetrable target and is visible through the aperture in the second sensor, penetrable target at locations of at least one of a head and a chest area of the living creature, thus requiring a projectile to not penetrate the second sensor, penetrable target; an accurate projectile passing through the second sensor, penetrable target aperture causes the projectile to only penetrate the first sensor, penetrable target.

3. The portable target apparatus of claim 1, wherein a control circuit extinguishes or illuminates for a predetermined time interval, a colored indicating light when the first sensor, penetrable target intended to be penetrated by a projectile is penetrated by a projectile; and the control circuit also being capable to extinguish or illuminate the colored indicating light for a different predetermined time interval whenever the second sensor, penetrable target not intended to be penetrated by a projectile is penetrated by a projectile.

4. The portable target apparatus of claim 1, further comprising: an automatic reset apparatus operable to move the first sensor, penetrable target from an upright position to a non-upright position; and the automatic reset apparatus also to be operable to move the first sensor, penetrable target from a non-upright position to an upright position after the completion of a user selectable time interval.

* * * * *